United States Patent [19]

Chalmers et al.

[11] 4,130,974

[45] Dec. 26, 1978

[54] SIDING PANELS AND THE METHOD OF PRODUCTION

[75] Inventors: Alexander A. Chalmers, Warren; J. Lynn Gailey, Newton Falls; Carl A. Wollam, Cortland, all of Ohio

[73] Assignee: Alcan Aluminum Corporation, Cleveland, Ohio

[21] Appl. No.: 769,342

[22] Filed: Feb. 16, 1977

[51] Int. Cl.[2] ..... E04D 3/30

[52] U.S. Cl. ..... 52/531; 29/155 R; 52/555; 52/558; 72/177; 72/181

[58] Field of Search ..... 52/518, 519, 521, 531, 52/558, 555; 29/155 R; 72/177, 181

[56] References Cited

U.S. PATENT DOCUMENTS

| | | | |
|---|---|---|---|
| 359,605 | 3/1887 | Harry | 52/531 |
| 1,700,138 | 1/1929 | Murray, Jr. | 52/531 |
| 1,993,086 | 3/1935 | Chaffee | 52/535 X |
| 2,118,191 | 5/1938 | Goldsmith | 52/519 |
| 2,781,877 | 2/1957 | Ochiltree | 52/521 |
| 3,312,031 | 4/1967 | Berg | 52/521 |
| 3,380,214 | 4/1968 | Stevens | 52/478 |
| 3,412,517 | 11/1968 | Ellis et al. | 52/520 |
| 3,754,366 | 8/1973 | Jansson et al. | 52/555 |
| 4,015,391 | 4/1977 | Epstein et al. | 52/531 |

FOREIGN PATENT DOCUMENTS

| | | | |
|---|---|---|---|
| 504549 | 7/1954 | Canada | 52/531 |

*Primary Examiner*—Alfred C. Perham
*Attorney, Agent, or Firm*—Cooper, Dunham, Clark, Griffin & Moran

[57] ABSTRACT

A horizontally elongated sheet metal siding panel simulating the appearance of a row of shake-type wooden shingles is produced by forming, in the panel, alternating raised and depressed shingle-simulating portions having surfaces lying in spaced parallel planes and separated by narrow portions that taper upwardly as viewed in projection in the surface planes of the shingle-simulating portions.

15 Claims, 19 Drawing Figures

Fig. 5 A&B.

Fig. 7.
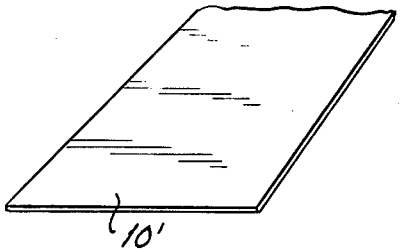
Fig. 6.
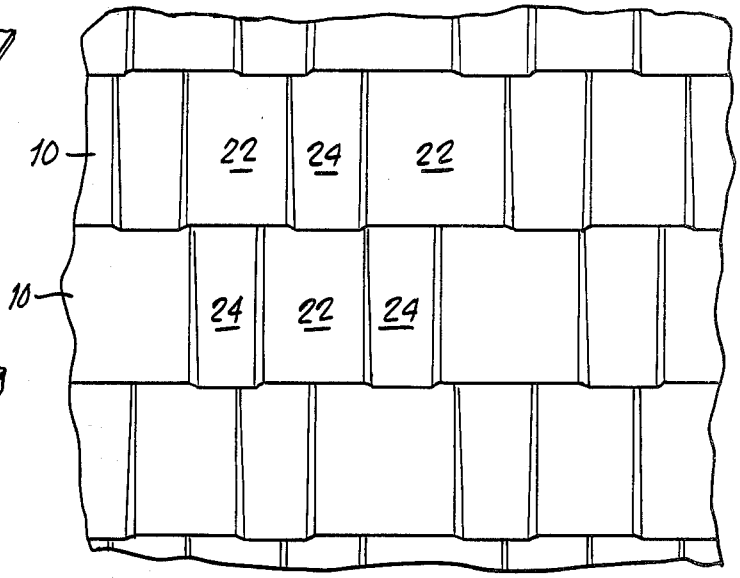
Fig. 8.
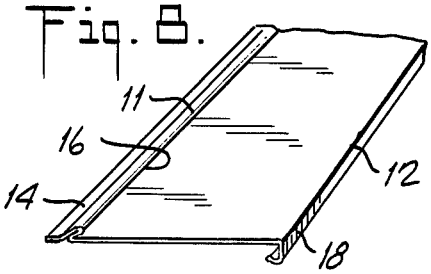
Fig. 9.
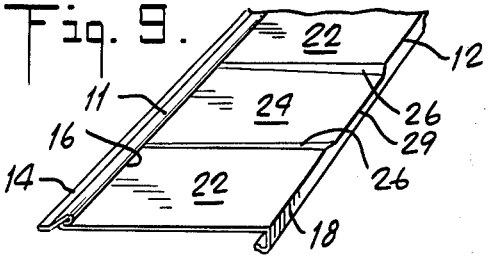
Fig. 10.
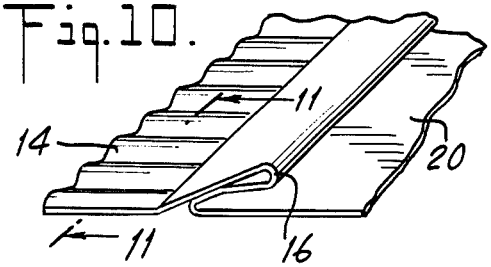
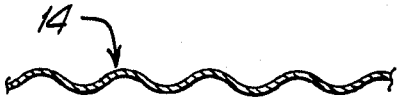
Fig. 11.
Fig. 12.
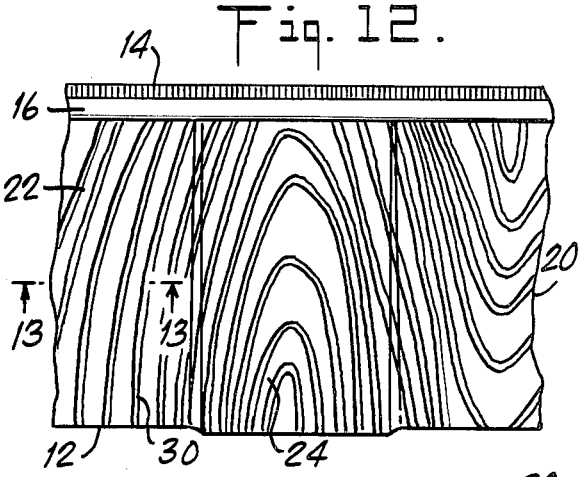
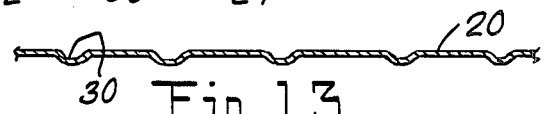
Fig. 13.
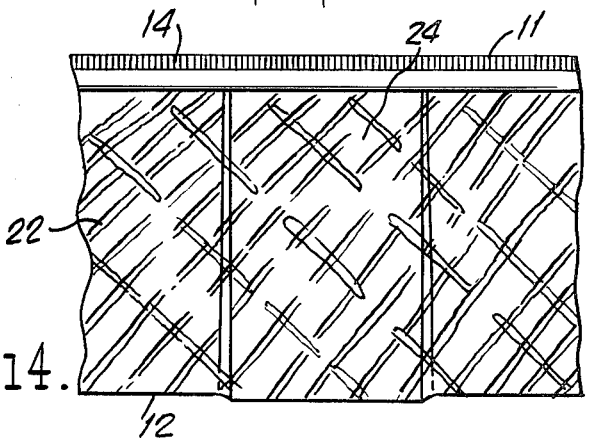
Fig. 14.

Fig. 15.
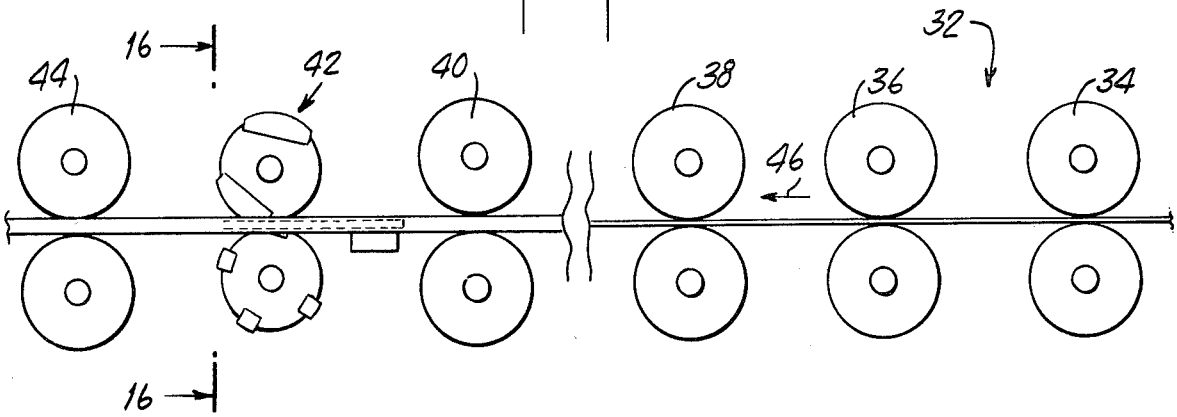
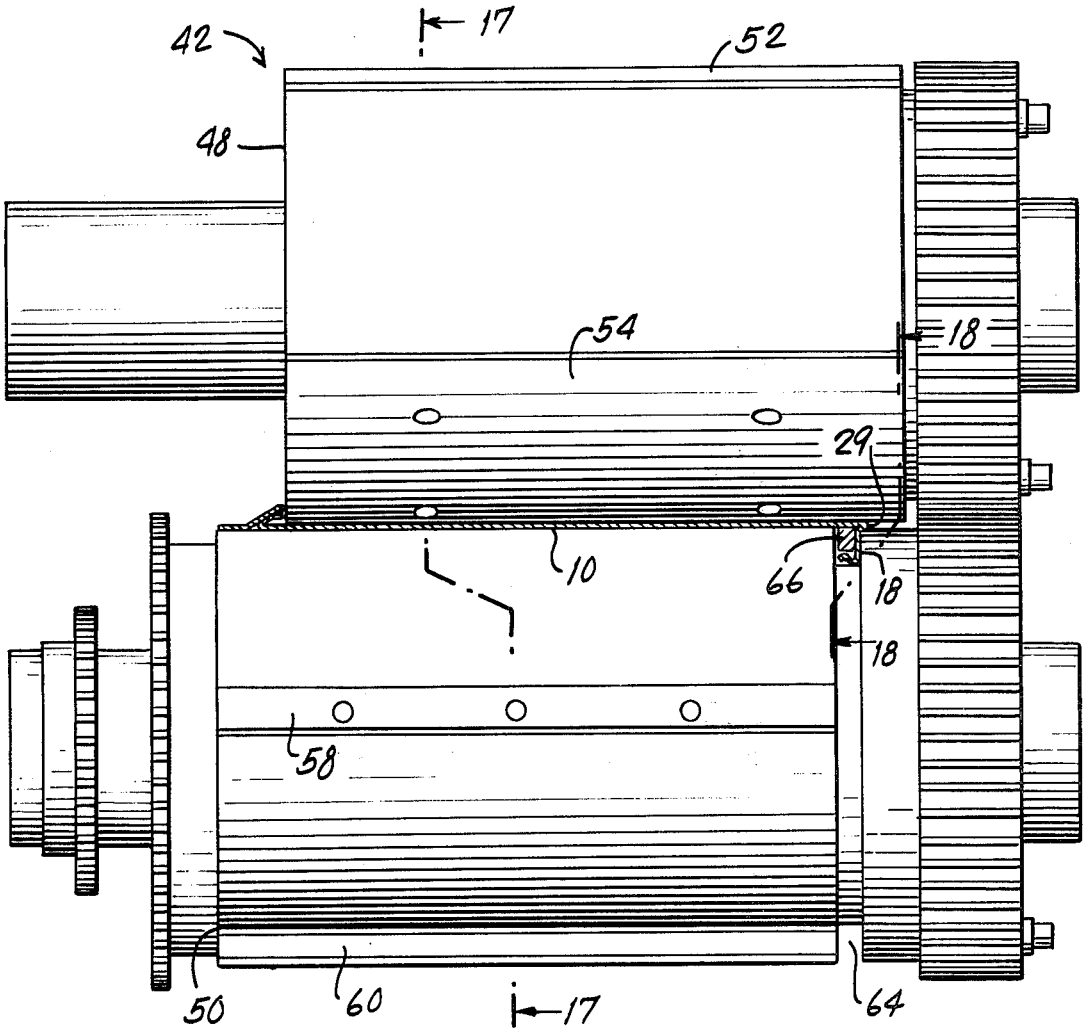
Fig. 16.

SIDING PANELS AND THE METHOD OF PRODUCTION

BACKGROUND OF THE INVENTION

This invention relates to the production of ductile sheet articles, such as metal siding panels, formed to simulate the appearance of building materials or the like having plural adjacent surfaces lying in diverging planes. In a specific sense, the invention is directed to horizontally elongated metal siding panels formed to resemble a row of wooden shake-type shingles, and to procedures for producing such panels.

For purposes of illustration, the invention will be described herein with particular reference to aluminum siding panels, it being understood that the term "aluminum" embraces aluminum metal and alloys thereof, and that the term "siding panels" includes panels suitable for installation on roofs as well as on walls.

Roll-formed aluminum siding panels are widely employed for cladding exterior walls of buildings. Typically, such panels are mounted one above another in parallel, overlapping, interlocked relation, each panel having a longitudinal bead or lip formed along its upper margin and a longitudinal inwardly bent channel flange formed along its lower margin. The panels are nailed or otherwise attached to a wall at their upper margins, which are substantially flush with the wall, and the channel flange of each panel interlocks with the lip of the panel immediately below it to secure the panel lower edge against dislodgment while holding the panel lower edge away from the wall, in a manner simulating the appearance of wooden clapboards. An advantage of panels of this type is that they can be of relatively great length (e.g. twelve feet or more in horizontal extent, with an exposed vertical dimension of, say, eight or ten inches), as is desired for convenience and facility of handling and installation.

While the described clapboard appearance of these panels is satisfactory for many installations, it is frequently desirable to provide other aesthetic or design effects in an exterior wall cladding having the functional advantages of aluminum or other sheet material siding. In particular, it is often desired to provide in such a cladding an appearance simulating wooden shingles of the type commonly known as shakes. Heretofore, however, proposed designs for shingle-simulating metal siding panels have involved difficult forming problems and have in general failed to achieve close resemblance to the true surface appearance of a row of wooden shakes. Moreover, owing in particular to the forming problems involved, the lengths of such shake-simulating panels have been restricted; i.e., it has not been possible to achieve a satisfactory metal panel product which acceptably simulates a row of wooden shakes in surface configuration and is comparable in length to the conventional metal panels described above. Thus, although long horizontal metal siding panels are greatly preferred by siding installers, for results including those mentioned above, no long (e.g. eight feet or more in horizontal dimension) shake-simulating metal panel has heretofore been available.

In explanation of the difficulties involved in attempting to achieve a long shake-simulating metal panel, it may be noted that the exposed surfaces of a row of wooden shakes typically lie in downwardly diverging planes. This feature can be simulated in an aluminum sliding panel by forming therein alternating first and second shingle-simulating portions each extending across the width of the panel with their surfaces respectively lying in downwardly diverging planes. However, because the divergence of these shingle-simulating portions from a common plane is significantly greater at the bottom of the panel than in the upper portion thereof, the bottom margin of the panel is gathered, i.e. effectively shortened in length relative to the upper panel portion. This difference in length may be tolerable if the panel is sufficiently short in horizontal extent, but in the case of the greatly elongated panels (comparable in length to conventional clapboard-like aluminum siding panels), such as are preferred by siding installers, the disparity in length between the lower margin and the upper portion of the panel is so great that is causes unacceptable cambering, bowing, and/or other distortion of the panel.

SUMMARY OF THE INVENTION

An object of the present invention is to provide procedures for producing elongated metal siding panels each formed to resemble a row of shake-type wooden shingles with advantageous superior fidelity of simulation, and with satisfactory freedom from cambering or other distortion. Another object is to provide such procedures for producing, in a panel as described, effective simulation of the appearance of adjacent shakes having surfaces respectively lying in downwardly diverging planes. A further object is to provide such procedures for producing shake-simulating panels comparable in horizontal dimension to the preferred lengths of the clapboard-like siding panels, e.g. lengths of as much as twelve feet or more. An additional object is to provide, more generally, methods of forming ductile sheet material to produce, in a single integral sheet, a surface appearance simulating plural adjacent surfaces lying in divergent planes. Still another object is to provide elongated sheet metal panels having the surface appearance of a row of shake-type shingles.

To these and other ends, the present invention in a particular sense contemplates forming, in an elongated ductile sheet siding panel, alternating raised and depressed shingle-simulating portions having extended surfaces respectively lying in spaced parallel planes and each extending across substantially the full width of the panel, while simultaneously forming panel portions extending obliquely between the raised and depressed portions, each of these obliquely extending portions being substantially narrower than the raised and depressed portions and tapering upwardly as viewed in projection in a plane parallel to the surfaces of the raised and depressed portions. Specifically, the raised shingle-simulating portions of the panel are formed with rectilinear lateral margins, all parallel to each other (and perpendicular to the longitudinal edges of the panel) while each of the depressed shingle-simulating portions is formed with rectilinear lateral margins that diverge upwardly such that each depressed portion is wider at the top than at the bottom. Thus each lateral margin of a depressed portion and the adjacent lateral margin of the adjacent raised portion converge upwardly (i.e. in the direction toward the upper margin of the panel), defining between them one of the obliquely extending portions; the upward convergence of the two last-mentioned margins defines the upward taper of the obliquely extending portion, the slope of which (relative to the planes of the shingle-simulating portions) increases progressively in an upward direction in correspondence with the convergence of these defining lateral margins.

The panel subjected to the foregoing forming steps may have preformed therein a longitudinal inwardly projecting flange extending along its bottom edge and an outwardly projecting longitudinal lip extending along its upper portion for interlocking with the bottom edge flange of another panel. This flange and lip may be formed in the same manner as in conventional clapboard-like aluminum siding panels. Typically, the upper edge of the panel projects above the lip and is oriented to lie substantially flush with a wall to which the panel is to be secured.

It is found that in a panel produced by the foregoing procedure, the shingle-simulating and obliquely extending portions cooperatively provide a visual effect or optical illusion of downwardly diverging shingle surfaces; i.e. the surfaces of adjacent raised and depressed shingle-simulating portions appear to lie in downwardly diverging planes notwithstanding that these surfaces in fact lie in essentially parallel spaced planes. Thus the formed panel effectively presents the appearance of a row of shake-type shingles having surfaces lying in downwardly diverging planes. Nevertheless, since the surfaces of adjacent shingle-simulating portions of the panel lie in parallel planes, while the obliquely extending portions between them taper upwardly and increase in slope in an upward direction, there is no greater gathering of material at the bottom edge of the panel than in the upper portion thereof, and the horizontal length of the panel is not reduced at the bottom edge relative to the upper portion of the panel. Indeed, a slightly greater horizontal length of material is required for the amount of deformation effected in the upper portion of the panel than is needed for the amount of deformation in the lower portion of the panel, but the formed longitudinal upper lip of the panel has a dimension-stabilizing effect that tends to cause this requirement to be accommodated by stretching of the metal in the upper portion of the panel during the forming operation. Consequently, the upper and lower panel edges remain substantially the same in length, so that the panel may be as long as is conventional for present-day aluminum siding panels (e.g. eight or twelve feet or even more in horizontal dimension, with a width of twelve inches or less) without exhibiting deleterious cambering or other distortion.

As a further feature of the invention, contributing to the effectiveness of simulation of the appearance of shake shingles, the bottom flange of the panel is deformed (incident to the forming of the shingle-simulating portions) so that the bottom margins of the depressed shingle-simulating portions project downwardly slightly beyond the bottom margins of the raised shingle-simulating portions. The resultant offset or broken butt line of the panel creates a shadow line (i.e. when an array of the panels is assembled on a wall and illuminated as by sunlight) resembling the irregular shadow line of a row of wooden shakes.

In addition, and further in accordance with the invention, the longitudinal upper edge portion of the panel above the lip is corrugated transversely to balance or compensate for the dimensional changes in the major portion of the panel caused by the forming of the shingle-simulating portions therein. This corrugation of the upper edge cooperates with the other features of the invention, described above, to maintain desired dimensional stability and freedom from distortion of the panel.

Stated with reference to the production of sheet metal siding panels, such as aluminum siding panels, the practice of the present procedure in preferred embodiments involves subjecting an initially flat metal strip to successive steps of forming therein a longitudinal upper lip and a longitudinal bottom flange; thereafter deforming, by cold working, the portion of the strip between the lip and the flange into a plurality of alternating raised and depressed shingle-simulating portions with intervening obliquely extending portions, all as described above; and thereafter, preferably, corrugating the upper edge of the strip above the lip. As is conventional, the strip may be painted or otherwise protectively coated prior to the forming operations; in addition, and again prior to the sequence of forming steps set forth above, the strip may, if desired, be embossed with a vertical or other wood grain pattern, it being understood that the term vertical refers to the direction transverse to the strip length, i.e. the direction which will be vertical when the finished panel is mounted on the wall.

The steps of forming the lip and flange may be in themselves entirely conventional roll-forming operations such as have heretofore been used to form like features in conventional metal siding panels. The step of forming the shingle-simulating and obliquely extending portions may also be effected by roll forming, e.g., using an appropriately constructed stand of rolls in line with other, conventional stands of rolls in a roll-forming line that performs in succession all the forming operations described above. The metal may be fed to the line as a continuous strip and cut to desired panel lengths at any convenient point.

The panel product of the invention, produced as by the foregoing procedure, is a horizontally elongated siding panel of sheet material self-sustaining in shape having an upper margin attachable to a wall in substantially flush relation thereto, a lower margin shaped to form a longitudinal inwardly projecting flange, and a continuous web extending from the upper to the lower margin over the full horizontal length of the panel to provide a downwardly and outwardly sloping, outwardly facing major surface of the panel, wherein the web comprises a plurality of alternating raised and depressed shingle-simulating portions with intervening obliquely extending portions, all as described above. Each of the raised and depressed portions extends vertically from the upper portion of the panel to the bottom flange thereof and is of at least sufficient width to simulate an individual shake-type wooden shingle. Preferably, the panel has an aspect ratio (i.e. ratio of horizontal dimension or length to vertical dimension or width) of at least about 7:1, it being preferred that the panels be ten feet or more in length and about eight to about sixteen inches in exposed width. These panels, when installed in overlapping parallel relation one above another on a wall, simulate in surface configuration the appearance of an array of wooden shingles or shakes wherein each row of shingles overlaps and projects beyond the upper portion of the next subjacent row, and within each row, individual shingles or groups of shingles project outwardly at what appear to be different slopes.

While the invention has been summarized above with reference to the production of shingle-simulating siding panels, in its broadest sense it embraces a method of forming ductile sheet material to produce, in a single integral sheet, a surface appearance simulating plural adjacent surfaces respectively lying in diverging planes, such method including the steps of working a sheet of ductile material for forming therein adjacent raised and depressed sheet portions having extended surfaces respectively lying in spaced parallel planes and simultaneously forming, in the sheet, portions extending obliquely between the raised and depressed portions, each of the obliquely extending portions being substantially narrower than the raised and depressed portions and (as viewed in projection in a plane parallel to the surfaces of the raised and depressed portions) tapering progressively along its length for producing an appearance of divergence of the surface planes of adjacent raised and depressed portions respectively lying on opposite sides thereof.

Further features of the invention will be apparent from the detailed description hereinbelow set forth, together with the accompanying drawings.

BRIEF DESCRIPTION OF THE DRAWINGS

FIG. 4 is a further enlarged composite sectional view taken as along the lines 5A—5A and 5B—5B of FIG. 2;

FIG. 6 is a front elevational view of a portion of a wall having mounted thereon an assembly of panels of the type shown in FIG. 1;

FIGS. 7, 8 and 9 are fragmentary perspective views illustrating successive steps in the procedure of the invention for forming a panel of the type shown in FIG. 1;

FIG. 10 is an enlarged fragmentary perspective view illustrating the corrugation of the upper edge of the panel;

FIG. 11 is a further enlarged fragmentary sectional view taken along the line 11—11 of FIG. 10;

FIG. 12 is a fragmentary front elevational view of a panel similar to that of FIG. 1 but having a vertical wood grain pattern embossed therein;

FIG. 13 is an enlarged fragmentary sectional view taken along the line 13—13 of FIG. 12;

FIG. 14 is a view similar to FIG. 12 showing a panel having another embossed pattern therein;

FIG. 15 is a simplified schematic view of a roll-forming line for producing the panel of FIG. 1;

FIG. 16 is an enlarged elevational view, taken as along the line 16—16 of FIG. 15, of a roll stand for forming the shingle-simulating and obliquely extending portions in the panel of FIG. 1;

DETAILED DESCRIPTION

Figures 1, 2, 3, 4:
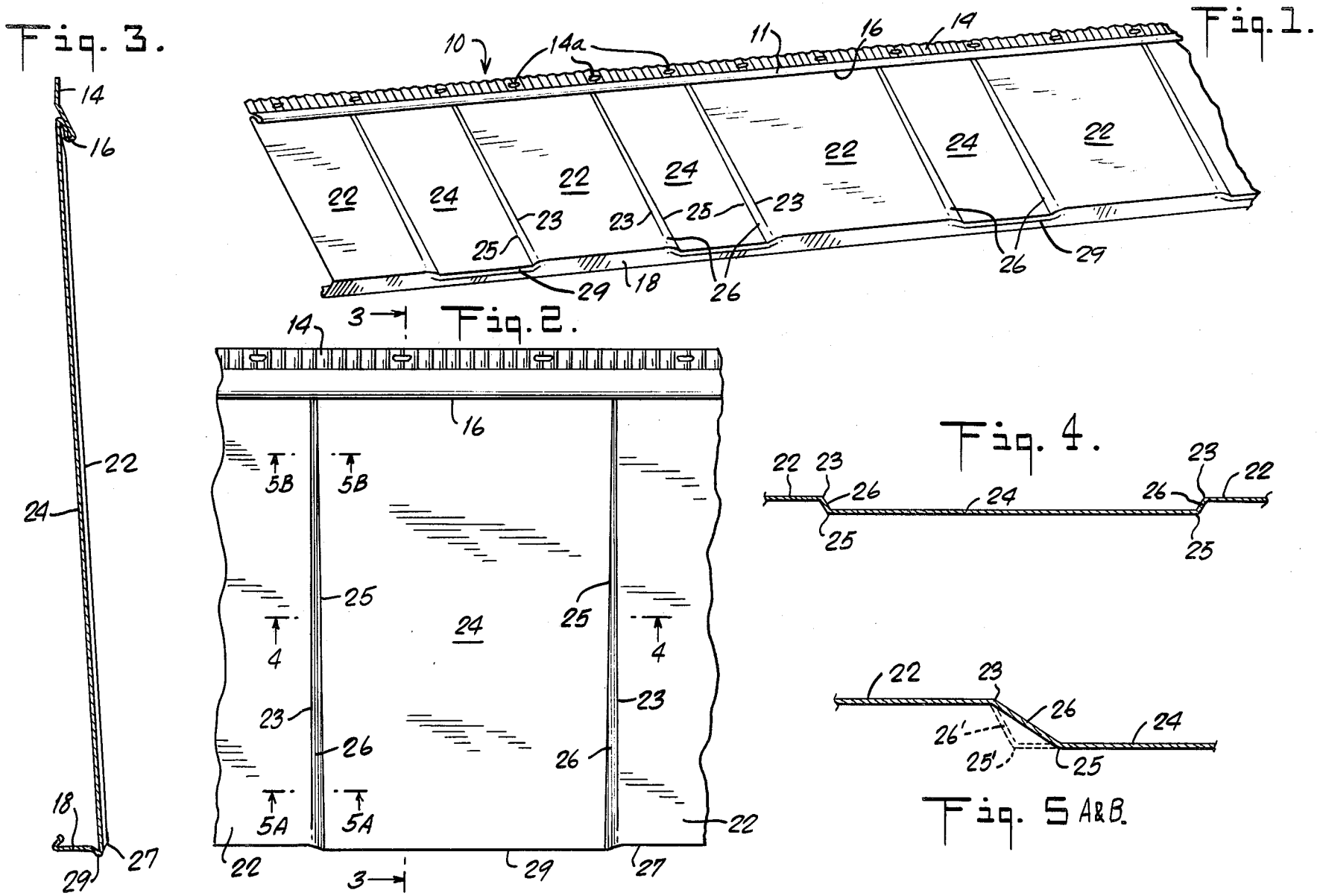
FIG. 1 is a perspective view of a siding panel embodying the present invention in a particular form, with one extremity of the panel omitted for simplicity of illustration.
FIG. 2 is an enlarged fragmentary front elevational view of a portion of the panel of FIG. 1.
FIG. 3 is a further enlarged sectional view taken along the line 3—3 of FIG. 2.
FIG. 4 is an enlarged sectional view taken along the line 4—4 of FIG. 2.
Figure 17:
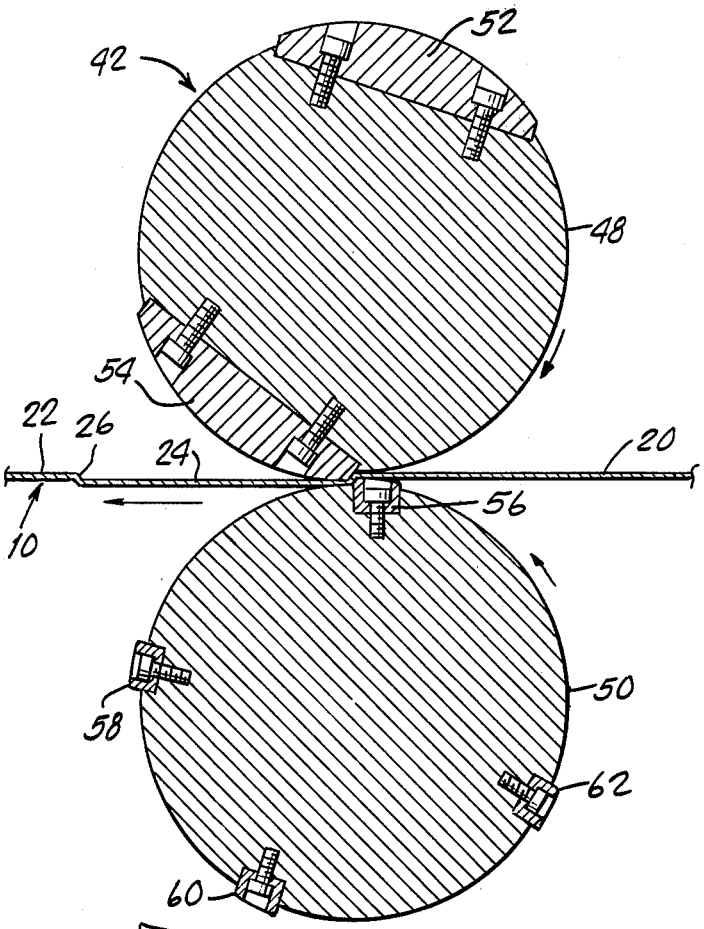
FIG. 17 is a sectional view taken along the line 17—17 of FIG. 16.
Figure 18:
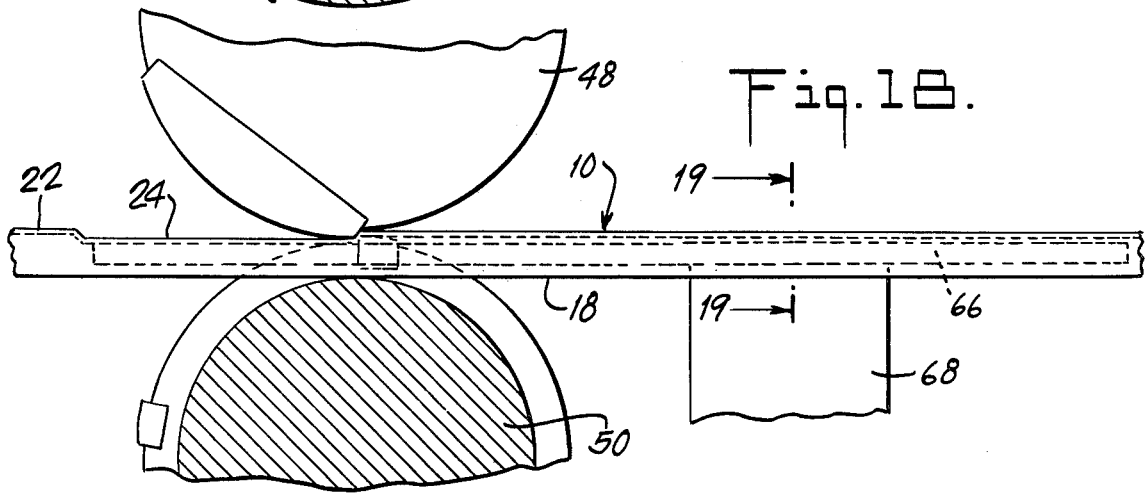
FIG. 18 is a fragmentary view taken as along the line 18—18 of FIG. 16.
Figure 19:
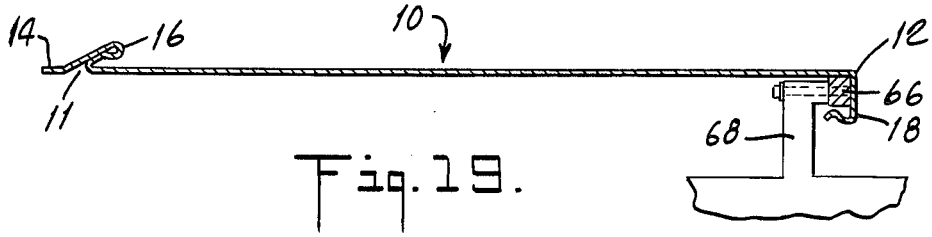
FIG. 19 is a sectional view taken along the line 19—19 of FIG. 18.

Referring first to FIGS. 1-5, the invention will be described as embodied in a horizontal siding panel formed from aluminum strip which has been precoated at least on its outwardly facing surface with one or more protective layers of paint. Thus, in FIG. 1, there is shown a horizontally elongated aluminum siding panel 10, of sufficiently heavy gauge to be self-sustaining in shape, having an upper margin 11 and a lower margin 12. Typically, the panel may have a vertical dimension (from upper to lower margin, after roll forming) of about nine inches, and it may be as much as twelve feet long (or even longer) in horizontal dimension.

The upper margin 11 has a longitudinal edge 14 which lies substantially flush with an exterior wall when the panel is installed, and through which (for example) nails or other fasteners may be driven at holes 14*a* spaced along the length of the panel to secure the panel to the wall. Immediately below the edge 14, the margin 11 is formed with an outwardly and downwardly projecting longitudinal lip 16 extending along the full length of the panel. The lower margin 12 is, as shown, bent inwardly and then upwardly to form an inwardly projecting longitudinal channel flange 18 which also extends along the full length of the panel. The major extent of the panel, between the upper and lower margins thereof, is a continuous web 20, having an outwardly facing major surface and formed as hereinafter further described. It will be understood that the terms "outwardly" and "inwardly" are used herein to refer to directions respectively away from and toward the wall on which the panel is mounted, and that the terms "upwardly" and "downwardly" are used with reference to the orientation of the panel when mounted on a wall.

When an assembly of the panels is mounted on an exterior wall, in parallel relation one above another with each panel extending horizontally and with the upper margin 11 of each panel secured in flush relation to the wall, the channel flange 18 of each panel overlaps and interlocks with the lip 16 of the panel immediately below it; thus each panel is fixedly held, along both upper and lower margins, against displacement. The lower portion of each panel is spaced away from the wall, and from the upper portion of the immediately subjacent panel, by the flange 18; the extent of such spacing is determined by the depth (transverse horizontal dimension) of the flange. Thus the web 20 of each panel slopes downwardly and outwardly from the upper margin to the lower margin thereof.

In accordance with the present invention, in this panel 10 (the features of which, as thus far described, are generally conventional for aluminum siding panels), the web 20 is formed into a plurality of raised shingle-simulating portions 22 and a plurality of depressed portions 24 disposed in alternating succession along the length of the panel and separated from each other by narrow, vertically oriented obliquely extending portions 26. Each of the portions 22 and 24 extends vertically from the upper portion of the panel (immediately beneath the lip 16) to the lower margin 12 of the panel and has a substantially planar outwardly facing major surface. These raised and depressed web portions 22 and 24 are each of such width (i.e. horizontal extent as measured along the length of the panel) as to simulate one or more conventional wooden shake-type shingles, although the raised and depressed portions are both preferably of random width, with some of the depressed portions being at least substantially equal in width to some of the raised portions.

More particularly, as best seen in FIG. 3, the raised shingle-simulating portions 22 are all formed with their outwardly facing major surfaces laying in a first common plane, while all the depressed shingle-simulating portions 24 are formed with their outwardly facing major surfaces lying in a second common plane that is parallel to and spaced inwardly from the plane of portions 22. Thus the depressed portions 24 are offset inwardly from the raised portions 22 by an amount which is at least essentially constant from the uppermost extent of these shingle-simulating portions immediately below the lip 16 all the way to the lower margin of the panel. The obliquely extending web portions 26 constitute those portions of the web which are bent obliquely (to the planes of portions 22 and 24) to accommodate the offsetting of portions 24 relative to portions 22.

The lateral margins of the raised shingle-simulating portions 22 are constituted by relatively sharply defined rectilinear vertical bends 23, while the lateral margins of the depressed shingle-simulating portions 24 are constituted by relatively sharply defined rectilinear bends 25. As most clearly seen in FIG. 2, the lateral margins or bends 25 on opposite sides of each depressed portion 24 diverge upwardly so that the portion 24 is slightly wider at the top than at the bottom. Since the margins or bends 23 laterally defining the raised portions 22 are all vertical, they are all parallel to each other, and each raised portion 22 is of uniform width from top to bottom.

Each of the obliquely extending portions 26 is defined between a lateral margin 23 of one of the raised shingle-simulating portions 22 and the adjacent lateral margin 25 of the adjacent depressed shingle-simulating portion 24. Owing to the above-described upward divergence of the margins 25 and to the vertical orientation of the margins 23, the margins 23 and 25 defining each obliquely extending portion converge upwardly (as viewed in projection in a plane parallel to the surface planes of the shingle-simulating portions), and therefore the obliquely extending portion 26 between them tapers upwardly (as viewed in the same plane).

Since the margins 23 and 25 defining each obliquely extending portion 26 respectively lie in spaced parallel planes, their upward convergence as viewed in projection requires that the slope of the surface of the obliquely extending portion 26 increase progressively in an upward direction. That is to say, in the lower portion of the panel, the slope of the portion 26 relative to the surface planes of portions 22 and 24 is comparatively gradual, but in the upper portion of the panel this slope is considerably steeper, as will be apparent from FIG. 5 wherein a section 5A—5A (see FIG. 2) in the lower portion of the panel is represented by solid lines, and a section 5B—5B in the upper portion of the panel is represented by broken lines. The slope of the surface 26 at the lower section is much more gradual than the slope 26' at the upper section in correspondence with the progressive apparent convergence of margin 25 with margin 23 (the position of margin 25 at the upper section of the panel being represented in FIG. 5 by point 25'). As will be understood, the change in slope of portion 26 represented by FIG. 5 is smooth and continuous from the bottom margin of the panel to the upper extremity of portion 26.

It is found that the described configuration of the panel web 20, including the raised and depressed shingle-simulating portions and the obliquely extending portions therebetween, creates a visual effect or optical illusion of downward divergence of the surface planes of portions 22 and 24, i.e. simulating the appearance of a row of wooden shake shingles, notwithstanding that the surface planes of portions 22 and 24 are actually parallel rather than diverging. The described configuration of the formed web 20 does not require a greater surface length of metal in the lower portion of the panel than in the upper portion of the panel as would be the case if the planes of portions 22 and 24 were downwardly diverging; hence the bottom margin of the panel is not gathered or shortened relative to the upper portion of the panel, and cambering or other deleterious distortion is avoided. From a consideration of FIG. 5, it will be apparent that the surface length of metal required in the upper portion of the formed web is greater than that required in the lower portion of the formed web, since the distance from point 23 to point 25 is greater measured along the broken line 26' than the same distance measured along the solid line 26. However, the lip 16 (which is formed in the panel before the shingle-simulating portions are formed, as further explained below) has a dimension-stabilizing effect such that the greater length of metal required in the upper portion of the web tends to be provided by stretching incident to the forming operation rather than by gathering and shortening of the upper portion of the panel.

As a further feature of the invention, for enhancing the simulation of appearance of wooden shakes, the portions of the panel bottom margin 12 coincident with the depressed portions 24 are deformed downwardly as indicated at 29 (FIGS. 2 and 3) so as to project farther downwardly than the bottom margin portions 27 coincident with the raised web portions 22. In other words, by virtue of this deformation of the panel bottom margin at the localities of the depressed portions, the depressed portions are made to project slightly farther downwardly than the raised portions, creating an irregular butt line which is similar to that found in a row of wooden shakes and which, when an assembly of the panels is mounted on a wall (i.e. in the manner shown in FIG. 6) and illuminated as by sunlight, produces a shadow line resembling that produced by a row of shakes. As will further be apparent from FIG. 3, in conformity with the general surface configuration of a shingled wall, the spacing between the major surface planes of adjacent portions 22 and 24 is a minor fraction of the depth of flange 18 measured along a line perpendicular to those surface planes.

The procedure of the invention for producing a panel of the type illustrated in FIG. 1 may be understood by reference to FIGS. 7–10, which illustrate successive steps in that procedure. The starting material for the procedure may be a flat strip 10' of aluminum, typically prepainted on its outer surface and of indeterminate length, e.g. provided as a coil. Initially, the longitudinal edges of this strip are formed as shown in FIG. 8 to produce the upper lip 16 and bottom flange 18, in like manner as in conventional aluminum siding panels. Thereafter, as shown in FIG. 9, the raised and depressed portions 22 and 24 and the obliquely extending portions 26 are formed in the panel web 20, the downward projection 29 of each depressed portion 24 being produced by deformation of the panel bottom margin 12 as the depressed portions 24 are formed. Finally, as shown in FIG. 10, the upper edge 14 of the panel above the lip 16 is transversely corrugated to compensate for dimensional changes caused by the preceding step of forming the web 20. These corrugations are shown in cross section in FIG. 11.

A vertical or other wood-grain pattern may be embossed in the strip 10', prior to the forming steps illustrated in FIGS. 8–10, to impart to the shingle-simulating portions 22 and 24 of the finished panel a naturally grained appearance. A product having an embossed vertical grain pattern is shown in FIGS. 12 and 13, while a diagonally oriented embossed grain pattern is shown in FIG. 14. The embossing involves surface deformation of the strip as indicated at 30 in FIGS. 12 and 13, but the depth of the deformation is small in relation to the spacing between the planes of the raised and depressed shingle-simulating portions 22 and 24.

While the shingle-simulating and obliquely extending portions may be formed in the panel web by a variety of cold-working techniques, it is especially convenient to produce the shingle-simulating configuration by roll forming, and indeed one important specific advantage of the shingle-simulating structure of the panel of FIG. 1 is that it can readily be formed by a stand of appropriately constructed rolls incorporated in an otherwise conventional roll-forming line in which all of the steps of forming the finished panel from the initial strip 10' are performed in succession.

FIGS. 15–19 illustrate roll-forming apparatus suitable for performing the steps illustrated in FIGS. 8–10, specifically including the steps of forming the shingle-simulating and obliquely extending portions in the panel web. In FIG. 15, there is schematically shown a roll-forming line 32 comprising a succession of roll stands 34, 36, 38, 40, 42 and 44 through which the strip 10' is advanced in succession in the direction indicated by arrow 46. Each of these roll stands comprises an upper roll and a lower roll between which the strip is advanced. The successive roll stands work the strip, forming therein the longitudinal flange and lip, the shingle-simulating and obliquely extending portions, and the top edge corrugations. The strip is cut (e.g. in conventional manner) to panels of desired length at any suitable point in or at the end of the line.

More particularly, in the line 32, the roll stand 42 (shown in FIGS. 16–18) is designed to form the panel web 20 into the shingle-simulating configuration described above. This stand 42 includes an upper cylindrical roll 48 and a lower cylindrical roll 50 which are driven together through suitable conventional gearing. Mounted in the surface of the roll 42 are a pair of inserts 52 and 54 having relatively wide surfaces spaced radially outward from but concentric with the surface of the roll 48 itself. These inserts are unequally spaced and are of unequal width (measured around the circumference of the roll), corresponding in width and spacing to the desired width and spacing of the depressed shingle-simulating portions to be formed in the panel. As will be appreciated, the portions of the surface of roll 48 between the inserts 52 and 54 correspond in width and position to the raised portions 22 in the produced panel. Four narrow inserts 56, 58, 60 and 62 are mounted in the lower roll 50 in position to cooperate with the edges of the upper roll inserts 52 and 54 in the forming operation. A circumferential groove 64 is provided in the lower roll 50 adjacent the right-hand end thereof (as seen in FIG. 16) to accommodate the previously formed flange 18 of the panel. The left-hand end of the upper roll 48 as seen in FIG. 16 is offset to the right of the left-hand end of roll 50 so as to accommodate the preformed lip 16 of the panel advancing between the rolls.

In the practice of the present procedure using the apparatus of FIGS. 16–19, a strip or panel having the flange 18 and lip 16 already formed therein is advanced between the rolls 48 and 50 with the lip 16 oriented upwardly (and beyond the left-hand end of roll 48 as seen in FIG. 16) and with the flange 18 oriented downwardly and received in groove 64 of roll 50. A stationary bar mandrel 66, mounted on a stationary support 68 ahead of roll stand 42, extends along the path of strip or panel advance through groove 64 in position for register with the flange 18 of the advancing strip or panel. This mandrel cooperates with the rolls 48 and 50 to prevent excessive or undesired deformation of the flange 18 while the strip is passing between the rolls, while permitting limited deformation of the flange 18 as described below.

It will be appreciated that in the strip or panel advancing to the roll stand 42, the surface of the web 20 lies in a single plane. As the strip passes between the rolls 48 and 50, the inserts 52 and 54 of the upper roll in cooperation with the inserts 56, 58, 60 and 62 of the lower roll deform spaced portions of the web downwardly out of the original surface plane to produce the depressed shingle-simulating portions 24 while leaving between them other portions of the web (i.e. remaining in the original web surface plane) which then constitute the raised shingle-simulating portions 22. The interaction of the longitudinal edges of the upper and lower roll inserts completes the forming of the lateral margins of the shingle-simulating portions and of the obliquely extending portions 26. As best seen in FIG. 16, as the inserts 52 and 54 deform the depressed portions 24 out of the original web major surface plane, they also deform the bottom margin of the panel slightly to the right to produce the projecting margin portion 29. No such deformation of the panel bottom margin occurs during those periods of the roll cycle when the portions of roll 48 intermediate the inserts 52 and 54 are passing over the web; hence there is no downward deformation of the bottom margin of the raised shingle-simulating portions 22.

It is to be understood that the invention is not limited to the procedures and embodiments hereinabove specifically set forth, but may be carried out in other ways without departure from its spirit.

We claim:

1. Procedure for producing, from a string of ductile sheet material, a siding panel having a major surface configuration simulating a row of wooden shingles, comprising, in combination, the steps of:

(a) forming the strip for producing alternating raised and depressed portions thereof having extended surfaces respectively lying in spaced parallel planes and each extending upwardly from the bottom edge of the strip across substantially the full width thereof, adjacent ones of said raised and depressed portions each being of sufficient width to simulate adjacent wooden shingles; and (b) simultaneously forming the strip for producing portions thereof extending obliquely between adjacent raised and depressed portions, each of said obliquely extending portions being substantially narrower than the raised and depressed portions and having a surface with a slope, relative to the surface planes of the raised and depressed portions, that increases progressively in an upward direction, and each of said obliquely extending portions tapering upwardly as viewed in projection in a plane parallel to the surface planes of the raised and depressed portions for producing an appearance of downward divergence of the surface planes of the adjacent raised and depressed portions respectively lying on opposite sides thereof.

2. Procedure for producing, from a metal strip, a siding panel having a major surface configuration simulating a row of wooden shingles, comprising, in combination, the steps of:

(a) forming the strip for producing, in the upper portion and at the lower longitudinal edge of the strip respectively, an outwardly projecting longitudinal lip and an inwardly projecting longitudinal flange for interlocking with the lip of another panel;

(b) thereafter forming the strip for producing alternating raised and depressed portions thereof having extended surfaces respectively lying in spaced parallel planes and each extending from the flange to the lip, adjacent ones of said raised and depressed portions each being of sufficient width to simulate adjacent wooden shingles; and (c) simultaneously forming the strip for producing portions thereof extending obliquely between adjacent raised and depressed portions, each of said obliquely extending portions being substantially narrower than the raised and depressed portions and having a surface with a slope, relative to the surface planes of the raised and depressed portions, that increases progressively in an upward direction, and each of said obliquely extending portions tapering upwardly as viewed in projection in a plane parallel to the surface planes of the raised and depressed portions for producing an appearance of downward divergence of the surface planes of the adjacent raised and depressed portions respectively lying on opposite sides thereof.

3. Procedure according to claim 2, wherein the step of forming the raised and depressed portions comprises forming the raised portions with parallel rectilinear lateral margins perpendicular to the longitudinal edges of the strip and forming each of the depressed portions with opposite rectilinear lateral margins that diverge upwardly, and wherein the step of forming the obliquely extending portions comprises forming obliquely extending portions each defined between a lateral margin of a raised portion and the adjacent lateral margin of an adjacent depressed portion.

4. Procedure according to claim 3, wherein the step of forming the raised and depressed portions further includes deforming the lower edge portion of the panel while forming each depressed portion such that each depressed portion has a bottom margin that projects downwardly slightly beyond the bottom margin of each adjacent raised portion.

5. Procedure according to claim 3, wherein the step of forming the lip comprises forming the lip in a region of the panel spaced from the upper longitudinal edge thereof for providing a flat upper edge portion of the panel above said lip; and further including the step of transversely corrugating said upper edge portion after forming the raised and depressed portions and the obliquely extending portions in the panel.

6. Procedure according to claim 3, further including the step of embossing the strip with a wood-grain-simulating pattern prior to the step of forming said lip and said flange.

7. Procedure for forming ductile sheet material to produce in a single integral sheet a surface appearance simulating plural adjacent surfaces lying in divergent planes, comprising, in combination, the steps of:

(a) working a sheet of ductile material for forming therein adjacent raised and depressed sheet portions having extended surfaces respectively lying in spaced parallel planes and;

(b) simultaneously forming the sheet for producing portions thereof extending obliquely between said raised and depressed portions, each of said obliquely extending portions being subtantially narrower than the raised and depressed portions and having a surface with a slope, relative to the surface planes of the raised and depressed portions, that increases progressively along its length, and each of said obliquely extending protions, as viewed in projection in a plane parallel to the surfaces of the raised and depressed portions, tapering progressively along its length in the direction of increasing slope of its surface for producing an appearance of divergence of the surface planes of adjacent raised and depressed portions respectively lying on opposite sides thereof.

8. A horizontally elongated ductile sheet siding panel having a major surface configuration simulating a row of wooden shingles, said panel including (a) a longitudinal upper margin attachable to a wall in substantially flush relation thereto;

(b) a longitudinal lower margin bent inwardly to constitute a flange for supporting the lower part of the panel in outwardly spaced relation to a wall when said upper margin is attached to the wall; and (c) a continuous web extending between the upper and lower margins over the full horizontal length of the panel and sloping downwardly and outwardly from said upper margin to said lower margin, said web having an outwardly facing major surface;

wherein the improvement comprises:

(d) said web comprising a plurality of raised shingle-simulating portions and a plurality of depressed shingle-simulating portions disposed in alternating relation along the length of the web, said raised and depressed portions having extended surfaces respectively lying in spaced parallel planes, each of said raised and depressed portions extending upwardly from the lower margin of the panel across substantially the full width of the panel, adjacent ones of said raised and depressed portions each being of sufficient width to simulate adjacent wooden shingles; and (e) said web further comprising narrow, vertically oriented web portions extending obliquely between adjacent raised and depressed portions, each of said obliquely extending portions having a surface with a slope, relative to the surface planes of the raised and depressed portions, that increases progressively in an upward direction, and each of said obliquely extending portions tapering upwardly as viewed in projection in a plane parallel to the surface planes of the raised and depressed portions for producing an appearance of downward divergence of the surface planes of the adjacent raised and depressed portions respectively lying on opposite sides thereof.

9. A panel as defined in claim 8, wherein each of said raised portions has rectilinear lateral margins perpendicular to the lower margin of said panel; wherein each of said depressed portions has opposite rectilinear lateral margins diverging upwardly from the lower margin of the panel; and wherein each of said obliquely extending portions is defined between a lateral margin of one of said raised portions and the adjacent lateral margin of the adjacent depressed portion.

10. A panel as defined in claim 9, wherein said depressed portions have lower margins that project downwardly slightly beyond the lower margins of the raised portions.

11. A panel as defined in claim 10, wherein a longitudinal upwardly projecting lip is formed in the upper portion of the panel but in spaced relation to the upper margin thereof, thereby providing a panel portion intermediate said lip and upper margin; and wherein said last-mentioned panel portion is transversely corrugated throughout its length.

12. A panel as defined in claim 8, wherein the ratio of the horizontal dimension of the panel to the vertical dimension of the panel is at least about 7:1.

13. A siding panel having a major surface configuration simulating a row of wooden shingles, produced by the procedure of claim 1.

14. An integral sheet of ductile material having a surface appearance simulating plural adjacent surfaces lying in divergent planes, produced by the procedure of claim 7.

15. A method of creating, in a major surface of a sheet of ductile material, a visual illusion of plural adjacent surfaces lying in divergent planes without substantially altering the relative lengths of opposite edges of the sheet, thereby to prevent cambering of the sheet, said method comprising disposing adjacent extended surface portions of the sheet in spaced, substantially parallel plane while separating the adjacent extended surface portions by sheet portions extending obliquely therebetween, each of the obliquely extending portions being substantially narrower than the extended surface portions; and progressively varying the slope of each said obliquely extending portion, relative to said parallel planes, along the length of each said obliquely extending portion while progressively tapering each said obliquely extending portion along its length, as viewed in projection in a plane parallel to the surfaces of said extended surface portions, in the direction in which its slope increases.

* * * * *

UNITED STATES PATENT AND TRADEMARK OFFICE

CERTIFICATE OF CORRECTION

PATENT NO. : 4,130,974

DATED : December 26, 1978

INVENTOR(S) : Alexander A. Chalmers et al.

It is certified that error appears in the above-identified patent and that said Letters Patent are hereby corrected as shown below:

Col. 2, line 15, "is causes" should read --it causes-- .

Col. 5, line 30, "FIG. 4" should read --FIG. 5-- .

Col. 6, line 67, "laying" should read --lying-- .

Col. 10, line 42, "string" should read --strip-- .

Col. 14, line 10, "plane" should read --planes-- .

Signed and Sealed this

*Twenty-third* Day of *November 1982*

[SEAL]

*Attest:*

GERALD J. MOSSINGHOFF

*Attesting Officer*

*Commissioner of Patents and Trademarks*